US007854185B2

(12) United States Patent
Zhang et al.

(10) Patent No.: US 7,854,185 B2
(45) Date of Patent: Dec. 21, 2010

(54) RATCHET PLIERS WITH ADJUSTABLE JAW

(75) Inventors: Hanzhen Zhang, Tianjin (CN); Lei Zhang, Tianjin (CN)

(73) Assignee: Tianjin Runshi Science Development Co., Ltd., Beichen District, Tianjin (CN)

( * ) Notice: Subject to any disclaimer, the term of this patent is extended or adjusted under 35 U.S.C. 154(b) by 117 days.

(21) Appl. No.: 12/351,867

(22) Filed: Jan. 12, 2009

(65) Prior Publication Data

US 2010/0175512 A1 Jul. 15, 2010

(51) Int. Cl.
*B25B 13/46* (2006.01)

(52) U.S. Cl. ..... 81/315; 81/383.5; 81/385

(58) Field of Classification Search ..... 81/315, 81/313, 383.5, 385, 387, 427.5, 382, 60; 72/409.01, 409.09, 409.1, 409.11
See application file for complete search history.

(56) References Cited

U.S. PATENT DOCUMENTS 1,284,351 A * 11/1918 Jagielo ..... 81/427.5
3,277,751 A * 10/1966 Filia ..... 81/313
3,673,848 A * 7/1972 Filia ..... 72/409.14
4,048,877 A * 9/1977 Undin ..... 81/313
4,144,737 A * 3/1979 Izraeli ..... 72/409.11
5,012,666 A * 5/1991 Chen et al. ..... 72/409.01
6,128,943 A * 10/2000 Lemmens ..... 72/409.01

* cited by examiner

*Primary Examiner*—Hadi Shakeri

(57) ABSTRACT

A ratchet pliers with adjustable jaw includes a working head, an integrated retractable handle arrangement, a ratchet stepping arrangement and a rapid adjusting arrangement. The ratchet pliers with adjustable jaw has several advantages. Firstly, the rapid adjusting arrangement with simple operation and convenient use is capable of micro-adjusting a closure error of the jaw opening after clamping. Secondly, the integrated retractable handle arrangement is capable of adjusting a length of the handle according to different demands for a jaw clamping force so as to save energy of a user.

20 Claims, 5 Drawing Sheets

RATCHET PLIERS WITH ADJUSTABLE JAW

BACKGROUND OF THE PRESENT INVENTION

1. Field of Invention

The present invention relates to a hardware tool, and more particularly to a ratchet pliers with adjustable jaw.

2. Description of Related Arts

Existing a ratchet pliers has several drawbacks. For a traditional ratchet pliers without a rapid adjusting arrangement, the jaw is easily worn and torn after a long-term use. As a result, there is a closure error of the jaw, when the jaw is clamped. For a traditional ratchet pliers with a rapid adjusting arrangement, the rapid adjusting arrangement is difficult to operate. Furthermore, the handles can't be retracted to satisfy different demands of a user while clamping the jaw. There is an urgent need for a ratchet pliers with adjustable jaw which can be operated conveniently, and is capable of fixing the closure error of the torn jaw, and conveniently adjusting the length of the handle.

SUMMARY OF THE PRESENT INVENTION

An object of the present invention is to provide a ratchet pliers with adjustable jaw comprising a rapid adjusting arrangement for rapidly adjusting the closure size of the jaw as required to reduce the closure error of the jaw when the jaw is clamped.

Another object of the present invention is to provide a ratchet pliers with adjustable jaw comprising an integrated retractable handle arrangement to satisfy demands for different clamping forces of the jaw.

Accordingly, in order to accomplish the above object, the present invention provides a ratchet pliers with adjustable jaw, comprising:

a working head;

an integrated retractable handle arrangement connected with the working head, comprising:

a first integrated retractable handle unit comprising a first handle, wherein the first handle has a first handle connecting hole provided on an upper end thereof, a first regulating hole provided below the first handle connecting hole and a first fixing hole provided between the first handle connecting hole and the first regulating hole; and a second integrated retractable handle unit pivotally connected with the first integrated retractable handle unit, comprising a second handle, wherein the second handle has a second connecting hole on an upper end thereof, a second fixing hole fitted into the first fixing hole, a ratchet mounting hole, and a spring mounting hole provided below the ratchet mounting hole, wherein the second fixing hole is provided between the second connecting hole and the ratchet mounting hole;

a ratchet stepping arrangement connected with the integrated retractable handle arrangement; and a rapid adjusting arrangement fixedly connected with an upper end of the first handle, comprising:

a regulating nut; and an eccentric regulating pole having an eccentric regulating aperture, provided within the regulating nut, wherein the integrated retractable handle arrangement is connected with the working head at the first handle connecting hole and the second connecting hole, the ratchet stepping arrangement is connected with the integrated retractable handle arrangement at the ratchet mounting hole and the spring mounting hole, and the rapid adjusting arrangement is connected with the first handle at the first regulating hole.

Therefore, the present invention has several advantages. Firstly, the rapid adjusting arrangement with simple operation and convenient use is capable of micro-adjusting the closure error of the jaw opening after clamping. Secondly, the integrated retractable handle arrangement is capable of adjusting a length of the handle according to different demands for a jaw clamping force so as to save energy of a user.

These and other objectives, features, and advantages of the present invention will become apparent from the following detailed description, the accompanying drawings, and the appended claims.

DETAILED DESCRIPTION OF THE PREFERRED EMBODIMENT

Figure 1:
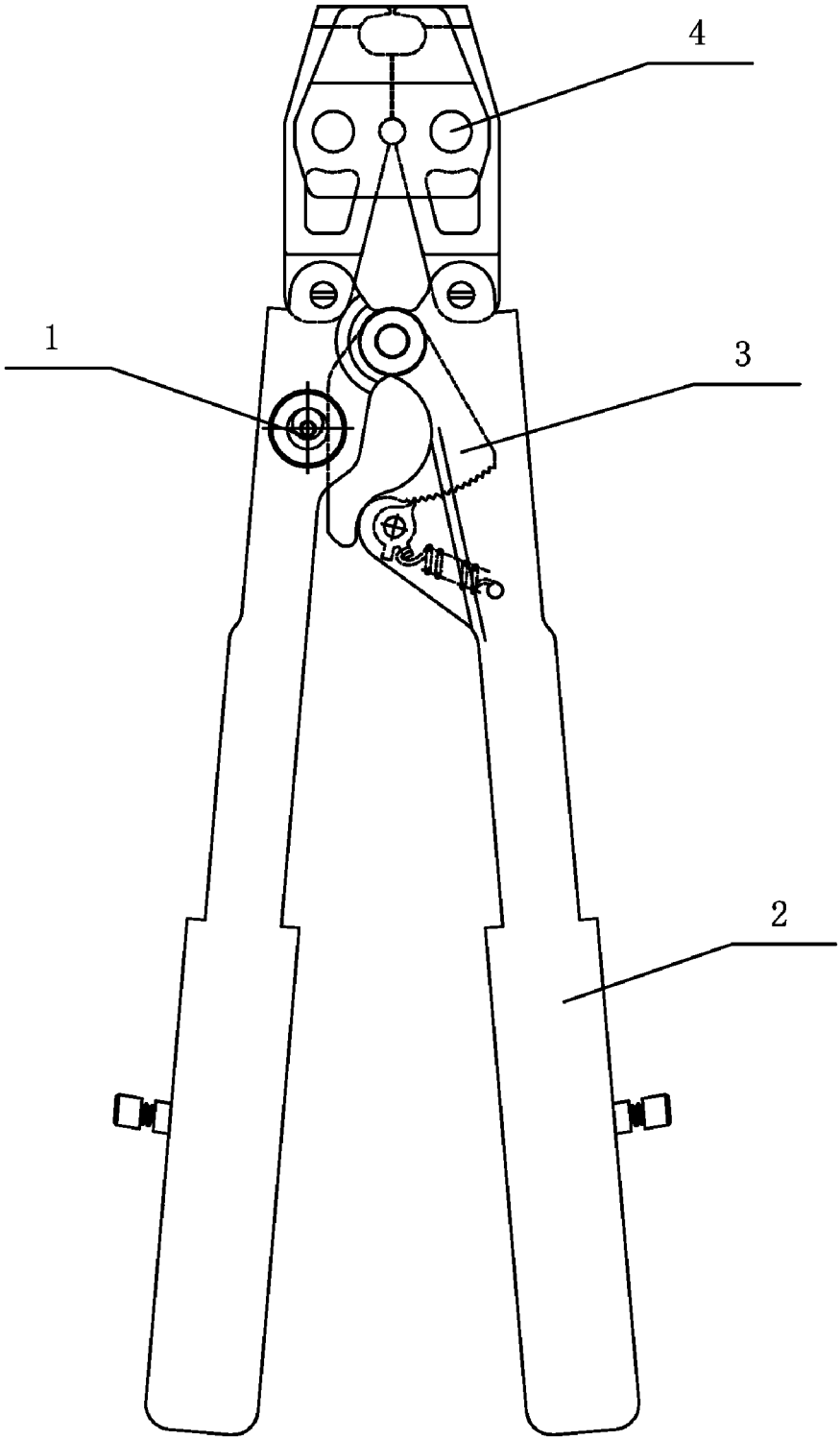
FIG. 1 is a front view of a ratchet pliers with adjustable jaw according to a first preferred embodiment of the present invention.

Referring to FIG. 1 of the drawings, a ratchet pliers with adjustable jaw according to a first preferred embodiment of the present invention is illustrated, in which the handle-operated ratchet pliers comprises a rapid adjusting arrangement 1, an integrated retractable handle arrangement 2, a ratchet stepping arrangement 3 and a working head 4.

Figure 2:
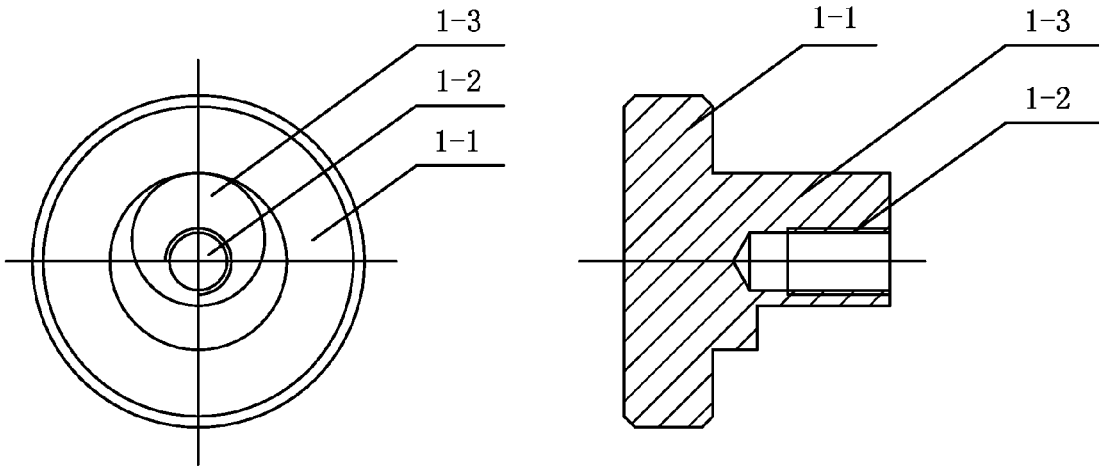
FIG. 2 is a sectional view of a rapid adjusting arrangement of the ratchet pliers with adjustable jaw according to the above first preferred embodiment of the present invention.

As shown in FIG. 2, the rapid adjusting arrangement 1 comprises a regulating nut 1-1, and an eccentric regulating pole 1-3 that has an eccentric regulating aperture 1-2, wherein the eccentric regulating pole 1-3 is axially provided within the regulating nut 1-1.

According to the present invention, the regulating nut 1-1 has a knurling for a user to conveniently operate the regulating nut.

Figure 3A:
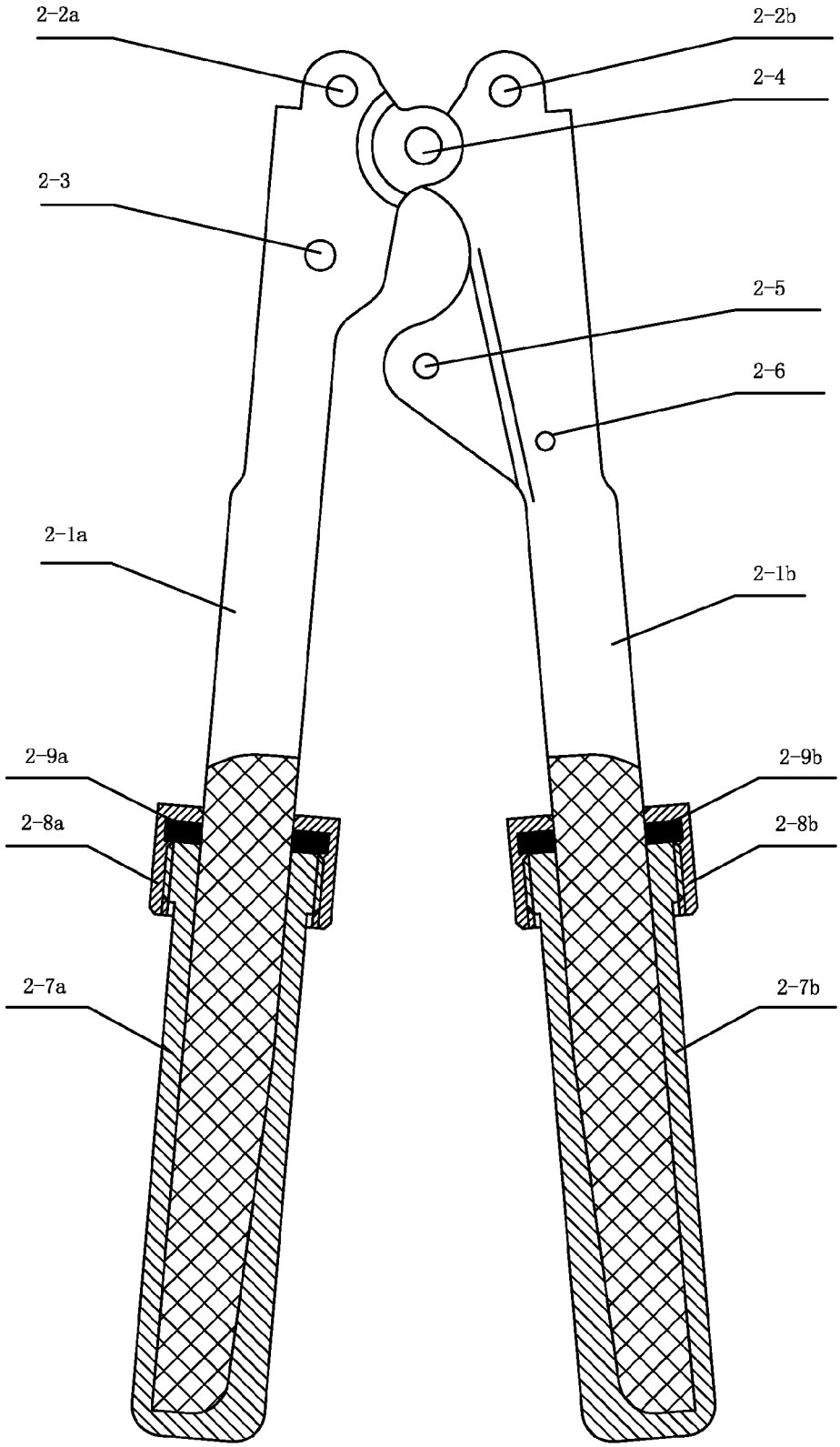
FIG. 3A is a semi-sectional view of an integrated retractable handle arrangement of the ratchet pliers with adjustable jaw according to the above first preferred embodiment of the present invention, illustrating a thread handle arrangement with damping materials.

As shown in FIG. 3A, the integrated retractable handle arrangement 2 comprises a first integrated retractable handle unit and a second integrated retractable handle unit pivotally connected with the first integrated retractable handle unit. The first integrated retractable handle unit comprises a first handle 2-1*a* fixedly connected with the rapid adjusting arrangement 1, wherein the first handle 2-1*a* has a first handle connecting hole 2-2*a* provided on an upper end thereof for mounting a pin to connect the first handle 2-1*a* and the working head 4, a first regulating hole 2-3 provided below the first handle connecting hole 2-2*a* for mounting a pin to connect the first handle 2-1*a* with the rapid adjusting arrangement 1, and a first fixing hole 2-4*a* provided between the first handle connecting hole 2-2*a* and the first regulating hole 2-3. The second integrated retractable handle unit comprises a second handle 2-1*b*, wherein the second handle 2-1*b* has a second connecting hole 2-2*b* provided on an upper end thereof for mounting a pin to connect the second handle 2-1*b* with the working head 4, a second fixing hole 2-4*b* fitted into the first fixing hole 2-4*a* and provided below the second connecting hole 2-2*b*, a ratchet mounting hole 2-5 for connecting the second handle 2-1*b* with the ratchet wheel 3-2, and a spring mounting hole 2-6 provided below the ratchet mounting hole 2-5 for connecting the second handle 2-1*b* with the ratchet stepping arrangement 3, wherein the second fixing hole 2-4*b* is provided between the second connecting hole 2-2*b* and the ratchet mounting hole 2-5.

The first integrated retractable handle unit further comprises a first handle casing 2-7*a* coaxially aligned with the first handle 2-1*a*, a first lock nut 2-8*a* coaxially aligned with the first handle 2-1*a* and threadedly connected with an external surface of an upper end portion of the first handle casing 2-7*a*, and a first lockwasher 2-9*a* transversely provided between the first lock nut 2-8*a* and the first handle casing 2-7*a*.

Accordingly, the second integrated retractable handle unit further comprises a second handle casing 2-7*b* coaxially aligned with the second handle 2-1*b*, a second lock nut 2-8*b* coaxially aligned with the second handle 2-1*b* and threadedly connected with an external surface of an upper end portion of the second handle casing 2-7*b*, and a second lockwasher 2-9*b* transversely provided between the second lock nut 2-8*b* and the second handle casing 2-7*b*.

Figure 4:
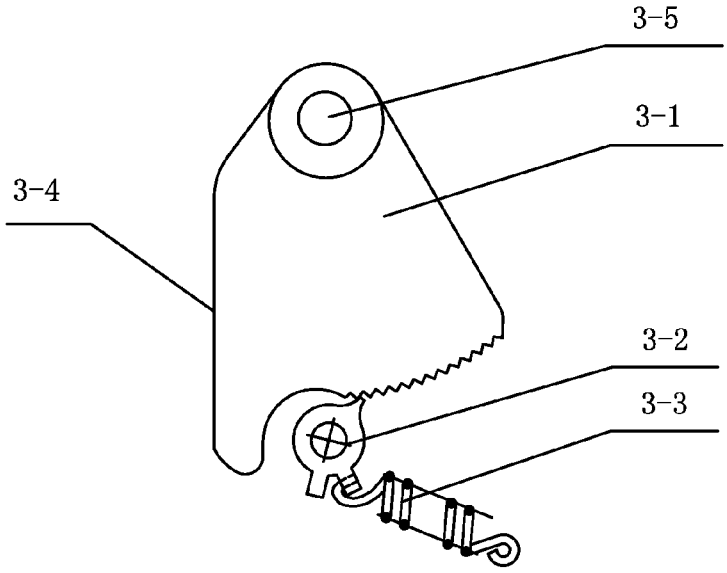
FIG. 4 is a front view of a ratchet stepping arrangement of the ratchet pliers with adjustable jaw according to the first preferred embodiment of the present invention.

As shown in FIG. 4, the ratchet stepping arrangement 3 comprises a ratchet plate 3-1, a ratchet wheel 3-2, and a ratchet spring 3-3, wherein the ratchet plate 3-1 has a third fixing hole 3-5. The ratchet plate 3-1 is connected with the integrated retractable handle arrangement 2 by a pin shaft through the third fixing hole 3-5. The ratchet wheel 3-2 is fixedly connected with the second handle 2-1*b* through the ratchet mounting hole 2-5 by a pin shaft. The ratchet wheel 3-2 is connected with an end of the ratchet spring 3-3. The second handle 2-1*b* is connected with an opposite end of the ratchet spring 3-3 through the spring mounting hole 2-6 by a pin shaft.

Figure 5:
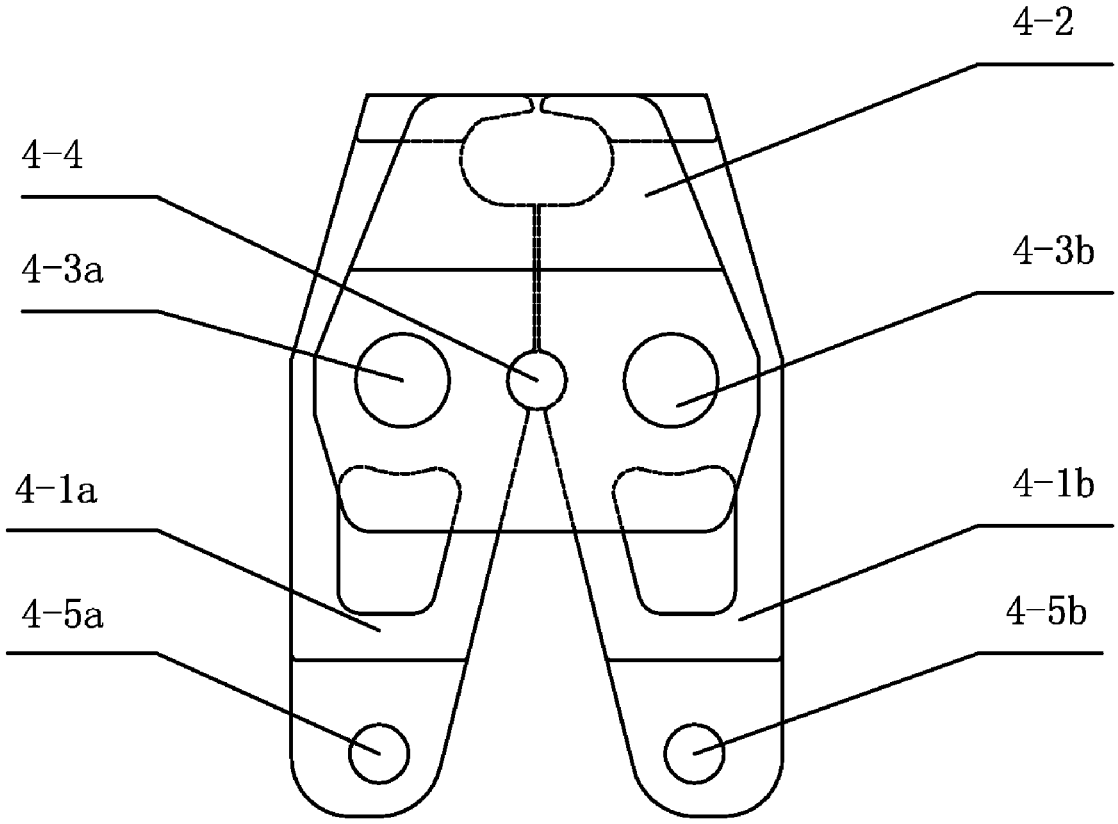
FIG. 5 is a front view of a working head of the ratchet pliers with adjustable jaw according to the preferred embodiment of the present invention.

As shown in FIG. 5, the working head 4 comprises a first head unit, a second head unit, a positioning shaft 4-4 movably connected the first head unit and the second head unit, and a cover board 4-2. The first head unit comprises a first jaw 4-1*a* and a first pin 4-3*a*, wherein the first head unit has a first head connecting hole 4-5*a*. The second head unit comprises a second jaw 4-1*b* and a second pin 4-3*b*, wherein the second head unit has a second head connecting hole 4-5*b*. The cover board 4-2 connects with the first head unit and the second head unit by the first pin 4-3*a* and the second pin 4-3*b* respectively. The integrated retractable handle arrangement 2 pivotally connects with the working head 4 at the first head connecting hole 4-5*a* and the second head connecting hole 4-5*b*, wherein the first head connecting hole 4-5*a* and the second head connecting hole 4-5*b* overlap with the first handle connecting hole 2-2*a* and the second connecting hole 2-2*b* respectively.

While a force is applied to the integrated retractable handle arrangement 2, the pawl of the ratchet wheel 3-2 is engaged with the gear teeth of the ratchet plate 3-1 for moving forwards, what is called a stepping process, so as to drive the working head 4 to work. Furthermore, an end of the ratchet wheel 3-2 is connected with the ratchet spring 3-3 such that while working, the pawl of the ratchet wheel 3-2 is induced for seizing up the gear teeth of the ratchet plate 3-1 to prevent backward motion. Going on applying a force, the pawl of the ratchet wheel 3-2 will disengage from the gear teeth of the ratchet plate 3-1 to complete the operation. Furthermore, after a long-term use, jaw is easily worn and torn so that there is a closure error of the jaw, when the jaw is clamped. Accordingly, a user may loose the binding screw connected with the rapid adjusting arrangement 1 to satisfy the closure size of the jaw opening after its clamping, then fasten the binding screw for completing the adjustment operation.

While adjusting the regulating nut 1-1, the eccentric regulating pole 1-3 relatively rotates around the eccentric regulating aperture 1-2 such that a pole surface of the eccentric regulating pole 1-3 blocks a plate surface of the ratchet plate 3-1 according to different rotation angles so as to adjust the closure size of the jaw in different degree.

After regulating the rapid adjusting arrangement for satisfy a demand for the closure size of the jaw opening, the binding screw is mounted within the eccentric regulating aperture 1-2.

Figure 3B:
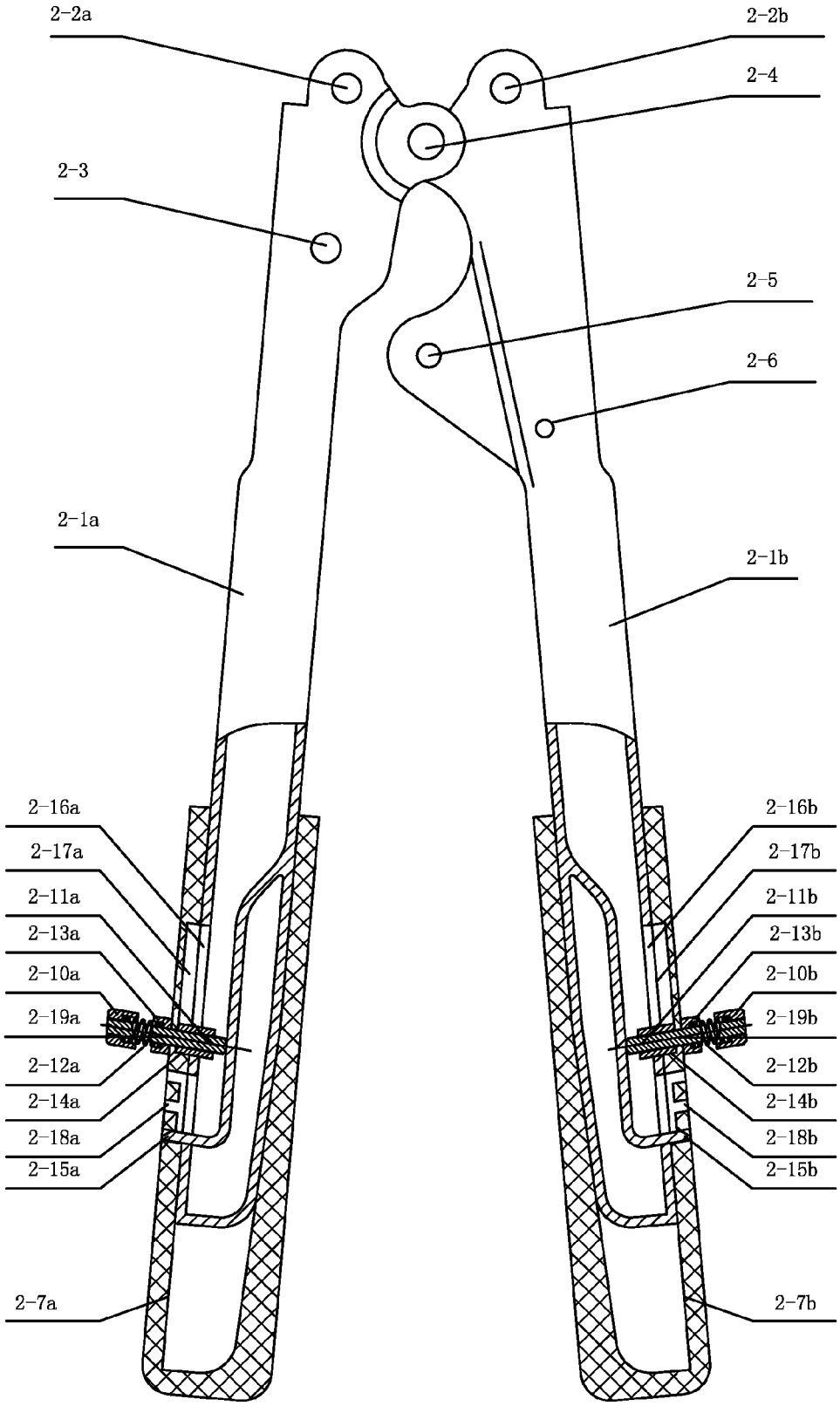
FIG. 3B is a semi-sectional view of the integrated retractable handle arrangement of the ratchet pliers with adjustable jaw according to a second embodiment of the present invention, illustrating a push-button handle arrangement with a slide way unit.

FIG. 3B is a second preferred embodiment of the integrated retractable handle arrangement of the ratchet pliers with adjustable jaw.

The integrated retractable handle arrangement 2 comprises a first integrated retractable handle unit having a first handle mounting hole 2-19*a*, and a second integrated retractable handle unit having a second handle mounting hole 2-19*b* pivotally connected with the first integrated retractable handle unit. The first integrated retractable handle unit comprises a first handle 2-1*a* fixedly connected with the rapid adjusting arrangement 1, wherein the first handle 2-1*a* has a first handle connecting hole 2-2*a* provided on an upper end thereof for mounting a pin to connect the first handle 2-1*a* and the working head 4, a first regulating hole 2-3 provided below the first handle connecting hole 2-2*a* for mounting a pin to connect the first handle 2-1*a* with the rapid adjusting arrangement 1, and a first fixing hole 2-4*a* provided between the first handle connecting hole 2-2*a* and the first regulating hole 2-3. The second integrated retractable handle unit comprises a second handle 2-1*b*, wherein the second handle 2-1*b* has a second connecting hole 2-2*b* provided on an upper end thereof for mounting a pin to connect the second handle 2-1*b* with the working head 4, a second fixing hole 2-4*b* fitted into the first fixing hole 2-4*a* and provided below the second connecting hole 2-2*b*, a ratchet mounting hole 2-5 for connecting the second handle 2-1*b* with the ratchet wheel 3-2, and a spring mounting hole 2-6 provided below the ratchet mounting hole 2-5 for connecting the second handle 2-1*b* with the ratchet stepping arrangement 3, wherein the second fixing hole 2-4*b* is provided between the second connecting hole 2-2*b* and the ratchet mounting hole 2-5.

The first integrated retractable handle unit further comprises a first handle casing 2-7*a* coaxially aligned with the first handle 2-1*a*, a first position limiter 2-15*a* provided within the first handle 2-1*a*, and a first adjusting push button perpendicularly connected with the first handle 2-1*a*, wherein the first handle casing 2-7*a* has a first casing guiding slot 2-17*a* therein aligned with an axis of the first handle 2-1*a*. The first position limiter 2-15*a* has a first position limit hole 2-18*a* therein and a first position limit guiding slot 2-16*a* therein. The first adjusting push button comprises a first button cap 2-10*a*, a first guiding member 2-14*a*, a first regulating shank 2-11*a* threadedly connected the first button cap 2-10*a* with the first guiding member 2-14*a*, a first spring block 2-13*a* provided on the first handle casing 2-7*a*, and a first spring 2-12*a* provided between the first button cap 2-10*a* and the first spring block 2-13*a*, wherein the first button cap 2-10*a*, the first guiding member 2-14*a*, the first regulating shank 2-11*a*, the first spring block 2-13*a* and the first spring 2-12*a* are coaxially aligned with each other. A bottom surface of the first spring block 2-13*a* contacts with an outer surface of the first handle casing 2-7*a*, the first guiding member 2-14*a* is located within the first position limit hole 2-18*a*, the first position limiter 2-15*a* is located within the first position limit hole 2-18*a* at a free position, wherein the first position limit guiding slot 2-16*a* is parallel to and communicated with the first casing guiding slot 2-17*a*.

Accordingly, the second integrated retractable handle unit further comprises a second handle casing 2-7*b* coaxially aligned with the second handle 2-1*b*, a second position limiter 2-15*b* provided within the second handle 2-1*b*, and a second adjusting push button perpendicularly connected with the second handle 2-1*b*, wherein the second handle casing 2-7*b* has a second casing guiding slot 2-17*b* therein aligned with an axis of the second handle 2-1*b*. The second position limiter 2-15*b* has a second position limit hole 2-18*b* therein and a second position limit guiding slot 2-16*b* therein. The second adjusting push button comprises a second button cap 2-10*b*, a second guiding member 2-14*b*, a second regulating shank 2-11*b* threadedly connected the second button cap 2-10*b* with the second guiding member 2-14*b*, a second spring block 2-13*b* provided on the second handle casing 2-7*b*, and a second spring 2-12*b* provided between the second button cap 2-10*b* and the second spring block 2-13*b*, wherein the second button cap 2-10*b*, the second guiding member 2-14*b*, the second regulating shank 2-11*b*, the second spring block 2-13*b* and the second spring 2-12*b* are coaxially aligned with each other. A bottom surface of the second spring block 2-13*b* contacts with an outer surface of the second handle casing 2-7*b*, the second guiding member 2-14*b* is located within the second position limit hole 2-18*b*, the second position limiter 2-15*b* is located within the second position limit hole 2-18*b* at a free position, wherein the second position limit guiding slot 2-16*b* is parallel to and communicated with the second casing guiding slot 2-17*b*.

People can adjust the integrated retractable handle arrangement 2 to satisfy the demand for different jaw clamping forces.

While a force is applied to the first integrated retractable handle unit, the first button cap 2-10*a*, the first regulating shank 2-11*a* and the first guiding member 2-14*a* are driven to move towards an inside of the first handle 2-1*a*, in such a manner that a first regulating end of the first regulating shank 2-11*a* pressed the first position limiter 2-15*a* for distortion to disengage the first position limiter 2-15*a* from the first position limit hole 2-18*a*. At the same time, the first guiding member 2-14*a* moves along the first position limit guiding slot 2-16*a* and the first casing guiding slot 2-17*a*. After adjusting the length of the first handle 2-1*a*, the first position limiter 2-15*a* is capable of returning an original position and automatically turning back within the first position limit hole 2-18*a* by loosing the first adjusting push button. In addition, the first guiding member 2-14*a* is automatically tightly pressed against the first spring block 2-13*a* so as to lock up the first handle 2-1*a* to adjust the length thereof.

Similarly, while a force is applied to the second integrated retractable handle unit, the operational principle is the same as that of the first integrated retractable handle unit.

All in all, a jaw clamping force is capable of changing by changing a length of the first handle 2-1*a* and the second handle 2-1*b*. That is to say, the jaw clamping force is changed with the change of a lever ratio of the integrated retractable handle arrangement 2 to the jaw opening.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A ratchet pliers with adjustable jaw, comprising:

a working head;

an integrated retractable handle arrangement connected with said working head, comprising:

a first integrated retractable handle unit comprising a first handle, wherein said first handle has a first handle connecting hole provided on an upper end thereof, a first regulating hole provided below said first handle connecting hole and a first fixing hole provided between said first handle connecting hole and said first regulating hole; and a second integrated retractable handle unit pivotally connected with said first integrated retractable handle unit, comprising a second handle, wherein said second handle has a second connecting hole on an upper end thereof, a second fixing hole fitted into said first fixing hole, a ratchet mounting hole, and a spring mounting hole provided below said ratchet mounting hole, wherein said second fixing hole is provided between said second connecting hole and said ratchet mounting hole;

a ratchet stepping arrangement connected with said integrated retractable handle arrangement; and a rapid adjusting arrangement fixedly connected with an upper end of said first handle, comprising:

a regulating nut; and an eccentric regulating pole having an eccentric regulating aperture, axially provided within said regulating nut, wherein said integrated retractable handle arrangement is connected with said working head at said first handle connecting hole and said second connecting hole, said ratchet stepping arrangement is connected with said integrated retractable handle arrangement at said ratchet mounting hole and said spring mounting hole, said rapid adjusting arrangement is connected with said first handle at said first regulating hole, wherein said first integrated retractable handle unit, having a first handle mounting hole, further comprises:

a first handle casing having a first casing guiding slot and coaxially aligned with said first handle;

a first position limiter, having a first position limit hole and a first position limit guiding slot, provided within said first handle; and a first adjusting push button perpendicularly connected with said first handle, comprising a first button cap, a first guiding member, a first regulating shank threadedly connected said first button cap with said first guiding member, a first spring block provided on said first handle casing, and a first spring provided between said first button cap and said first spring block, wherein said first button cap, said first guiding member, said first regulating shank, said first spring block and said first spring are coaxially aligned with each other, in such a manner that a bottom surface of said first spring block contacts with an outer surface of said first handle casing, said first guiding member is located within said first position limit hole, said first position limiter is located within said first position limit hole at a free position, wherein said first position limit guiding slot is parallel to and communicated with said first casing guiding slot;

wherein said second integrated retractable handle unit, having a second handle mounting hole, further comprises:

a second handle casing having a second casing guiding slot and coaxially aligned with said second handle;

a second position limiter, having a second position limit hole and a second position limit guiding slot, provided within said second handle; and a second adjusting push button perpendicularly connected with said second handle, comprising a second button cap, a second guiding member, a second regulating shank threadedly connected said second button cap with said second guiding member, a second spring block provided on said second handle casing, and a second spring provided between said second button cap and said second spring block, wherein said second button cap, said second guiding member, said second regulating shank, said second spring block and said second spring are coaxially aligned with each other, in such a manner that a bottom surface of said second spring block contacts with an outer surface of said second handle casing, said second guiding member is located within said second position limit hole, said second position limiter is located within said second position limit hole at a free position, wherein said second position limit guiding slot is parallel to and communicated with said second casing guiding slot.

2. The ratchet pliers with adjustable jaw, as recited in claim 1, wherein said regulating nut of said rapid adjusting arrangement has a knurling for a user to conveniently operate said regulating nut.

3. The ratchet pliers with adjustable jaw, as recited in claim 2, wherein said first integrated retractable handle unit further comprises a first handle casing coaxially aligned with said first handle, a first lock nut coaxially aligned with said first handle and threadedly connected with an external surface of an upper end portion of said first handle casing, and a first lockwasher transversely provided between said first lock nut and said first handle casing, wherein said second integrated retractable handle unit further comprises a second handle casing coaxially aligned with said second handle, a second lock nut coaxially aligned with said second handle and threadedly connected with an external surface of an upper end portion of said second handle casing, and a second lockwasher transversely provided between said second lock nut and said second handle casing.

4. The ratchet pliers with adjustable jaw, as recited in claim 3, wherein said ratchet stepping arrangement comprises a ratchet plate, a ratchet wheel, and a ratchet spring, wherein said ratchet plate has a third fixing hole connecting with said first fixing hole and said second fixing hole, wherein said ratchet wheel is fixedly connected with said second handle at said ratchet mounting hole, wherein said ratchet wheel is connected with an end of said ratchet spring, wherein said second handle is connected with an opposite end of said ratchet spring at said spring mounting hole.

5. The ratchet pliers with adjustable jaw, as recited in claim 4, wherein said working head comprises a first head unit, a second head unit, a positioning shaft movably connected said first head unit and said second head unit, and a cover board, wherein said first head unit comprises a first jaw and a first pin, wherein said first head unit has a first head connecting hole fitted into said first handle connecting hole, wherein said second head unit comprises a second jaw and a second pin, wherein said second head unit has a second head connecting hole fitted into said second handle connecting hole, wherein said cover board connects with said first head unit and said second head unit by said first pin and said second pin respectively, wherein said working head is connected with said integrated retractable handle arrangement at said first head connecting hole and said second head connecting hole.

6. The ratchet pliers with adjustable jaw, as recited in claim 3, wherein said working head comprises a first head unit, a second head unit, a positioning shaft movably connected said first head unit and said second head unit, and a cover board, wherein said first head unit comprises a first jaw and a first pin, wherein said first head unit has a first head connecting hole fitted into said first handle connecting hole, wherein said second head unit comprises a second jaw and a second pin, wherein said second head unit has a second head connecting hole fitted into said second handle connecting hole, wherein said cover board connects with said first head unit and said second head unit by said first pin and said second pin respectively, wherein said working head is connected with said integrated retractable handle arrangement at said first head connecting hole and said second head connecting hole.

7. The ratchet pliers with adjustable jaw, as recited in claim 2, wherein said ratchet stepping arrangement comprises a ratchet plate, a ratchet wheel, and a ratchet spring, wherein said ratchet plate has a third fixing hole connecting with said first fixing hole and said second fixing hole, wherein said ratchet wheel is fixedly connected with said second handle at said ratchet mounting hole, wherein said ratchet wheel is connected with an end of said ratchet spring, wherein said second handle is connected with an opposite end of said ratchet spring at said spring mounting hole.

8. The ratchet pliers with adjustable jaw, as recited in claim 7, wherein said working head comprises a first head unit, a second head unit, a positioning shaft movably connected said first head unit and said second head unit, and a cover board, wherein said first head unit comprises a first jaw and a first pin, wherein said first head unit has a first head connecting hole fitted into said first handle connecting hole, wherein said second head unit comprises a second jaw and a second pin, wherein said second head unit has a second head connecting hole fitted into said second handle connecting hole, wherein said cover board connects with said first head unit and said second head unit by said first pin and said second pin respectively, wherein said working head is connected with said integrated retractable handle arrangement at said first head connecting hole and said second head connecting hole.

9. The ratchet pliers with adjustable jaw, as recited in claim 2, wherein said working head comprises a first head unit, a second head unit, a positioning shaft movably connected said first head unit and said second head unit, and a cover board, wherein said first head unit comprises a first jaw and a first pin, wherein said first head unit has a first head connecting hole fitted into said first handle connecting hole, wherein said second head unit comprises a second jaw and a second pin, wherein said second head unit has a second head connecting hole fitted into said second handle connecting hole, wherein said cover board connects with said first head unit and said second head unit by said first pin and said second pin respectively, wherein said working head is connected with said integrated retractable handle arrangement at said first head connecting hole and said second head connecting hole.

10. The ratchet pliers with adjustable jaw, as recited in claim 2, wherein each of said ratchet mounting hole, said spring mounting hole, said first handle mounting hole and said second handle mounting hole is a through-hole having a same size.

11. The ratchet pliers with adjustable jaw, as recited in claim 1, wherein said first integrated retractable handle unit further comprises a first handle casing coaxially aligned with said first handle, a first lock nut coaxially aligned with said first handle and threadedly connected with an external surface of an upper end portion of said first handle casing, and a first lockwasher transversely provided between said first lock nut and said first handle casing, wherein said second integrated retractable handle unit further comprises a second handle casing coaxially aligned with said second handle, a second lock nut coaxially aligned with said second handle and threadedly connected with an external surface of an upper end portion of said second handle casing, and a second lockwasher transversely provided between said second lock nut and said second handle casing.

12. The ratchet pliers with adjustable jaw, as recited in claim 11, wherein said ratchet stepping arrangement comprises a ratchet plate, a ratchet wheel, and a ratchet spring, wherein said ratchet plate has a third fixing hole connecting with said first fixing hole and said second fixing hole, wherein said ratchet wheel is fixedly connected with said second handle at said ratchet mounting hole, wherein said ratchet wheel is connected with an end of said ratchet spring, wherein said second handle is connected with an opposite end of said ratchet spring at said spring mounting hole.

13. The ratchet pliers with adjustable jaw, as recited in claim 11, wherein said working head comprises a first head unit, a second head unit, a positioning shaft movably connected said first head unit and said second head unit, and a cover board, wherein said first head unit comprises a first jaw and a first pin, wherein said first head unit has a first head connecting hole fitted into said first handle connecting hole, wherein said second head unit comprises a second jaw and a second pin, wherein said second head unit has a second head connecting hole fitted into said second handle connecting hole, wherein said cover board connects with said first head unit and said second head unit by said first pin and said second pin respectively, wherein said working head is connected with said integrated retractable handle arrangement at said first head connecting hole and said second head connecting hole.

14. The ratchet pliers with adjustable jaw, as recited in claim 12, wherein said working head comprises a first head unit, a second head unit, a positioning shaft movably connected said first head unit and said second head unit, and a cover board, wherein said first head unit comprises a first jaw and a first pin, wherein said first head unit has a first head connecting hole fitted into said first handle connecting hole, wherein said second head unit comprises a second jaw and a second pin, wherein said second head unit has a second head connecting hole fitted into said second handle connecting hole, wherein said cover board connects with said first head unit and said second head unit by said first pin and said second pin respectively, wherein said working head is connected with said integrated retractable handle arrangement at said first head connecting hole and said second head connecting hole.

15. The ratchet pliers with adjustable jaw, as recited in claim 11, wherein each of said ratchet mounting hole, said spring mounting hole, said first handle mounting hole and said second handle mounting hole is a through-hole having a same size.

16. The ratchet pliers with adjustable jaw, as recited in claim 1, wherein said ratchet stepping arrangement comprises a ratchet plate, a ratchet wheel, and a ratchet spring, wherein said ratchet plate has a third fixing hole connecting with said first fixing hole and said second fixing hole, wherein said ratchet wheel is fixedly connected with said second handle at said ratchet mounting hole, wherein said ratchet wheel is connected with an end of said ratchet spring, wherein said second handle is connected with an opposite end of said ratchet spring at said spring mounting hole.

17. The ratchet pliers with adjustable jaw, as recited in claim 16, wherein said working head comprises a first head unit, a second head unit, a positioning shaft movably connected said first head unit and said second head unit, and a cover board, wherein said first head unit comprises a first jaw and a first pin, wherein said first head unit has a first head connecting hole fitted into said first handle connecting hole, wherein said second head unit comprises a second jaw and a second pin, wherein said second head unit has a second head connecting hole fitted into said second handle connecting hole, wherein said cover board connects with said first head unit and said second head unit by said first pin and said second pin respectively, wherein said working head is connected with said integrated retractable handle arrangement at said first head connecting hole and said second head connecting hole.

18. The ratchet pliers with adjustable jaw, as recited in claim 16, wherein each of said ratchet mounting hole, said spring mounting hole, said first handle mounting hole and said second handle mounting hole is a through-hole having a same size.

19. The ratchet pliers with adjustable jaw, as recited in claim 1, wherein said working head comprises a first head unit, a second head unit, a positioning shaft movably connected said first head unit and said second head unit, and a cover board, wherein said first head unit comprises a first jaw and a first pin, wherein said first head unit has a first head connecting hole fitted into said first handle connecting hole, wherein said second head unit comprises a second jaw and a second pin, wherein said second head unit has a second head connecting hole fitted into said second handle connecting hole, wherein said cover board connects with said first head unit and said second head unit by said first pin and said second pin respectively, wherein said working head is connected with said integrated retractable handle arrangement at said first head connecting hole and said second head connecting hole.

20. The ratchet pliers with adjustable jaw, as recited in claim 1, wherein each of said ratchet mounting hole, said spring mounting hole, said first handle mounting hole and said second handle mounting hole is a through-hole having a same size.

* * * * *